US006877533B2

(12) United States Patent
Roskam

(10) Patent No.: US 6,877,533 B2
(45) Date of Patent: Apr. 12, 2005

(54) VOID-FILL BAG FILLING SYSTEM AND METHOD

(75) Inventor: Mervin W. Roskam, Hoover, AL (US)

(73) Assignee: Roskam Automatic Machinery, Inc., Birmingham, AL (US)

( * ) Notice: Subject to any disclaimer, the term of this patent is extended or adjusted under 35 U.S.C. 154(b) by 137 days.

(21) Appl. No.: 10/361,663

(22) Filed: Feb. 10, 2003

(65) Prior Publication Data

US 2003/0150512 A1 Aug. 14, 2003

Related U.S. Application Data

(60) Provisional application No. 60/356,270, filed on Feb. 11, 2002.

(51) Int. Cl.[7] ..... B65B 1/04
(52) U.S. Cl. ..... 141/114; 141/314; 141/94
(58) Field of Search ..... 141/10, 114, 313–317, 141/391, 94; 206/522, 591; 383/3; 410/419

(56) References Cited

U.S. PATENT DOCUMENTS 5,609,190 A * 3/1997 Anderson et al. ..... 141/59
5,901,850 A * 5/1999 Jones et al. ..... 206/522
6,561,236 B1 * 5/2003 Sperry et al. ..... 141/314

* cited by examiner

*Primary Examiner*—Steven O. Douglas
(74) *Attorney, Agent, or Firm*—Thomas, Kayden, Horstemeyer & Risley, L.L.P.

(57) ABSTRACT

A system and method for securing package contents is provided. One embodiment which secures package contents comprises a supply conveyor configured to transport at least one package having at least one deflated void-fill bag, the void-fill bag having a collar protruding through the package, an inflate nozzle configured to sealably couple with the collar such that the void-fill bag may be filled to secure contents of the package, a vision system configured to detect a target associated with the collar of the void-fill bag, and a servo-drive system configured to control a position of the inflate nozzle based upon the detected target such that the position of the inflate nozzle is adjusted to sealably couple the inflate nozzle with the collar.

29 Claims, 9 Drawing Sheets

VOID-FILL BAG FILLING SYSTEM AND METHOD

CROSS-REFERENCE TO RELATED APPLICATION

This application claims priority to co-pending U.S. provisional application entitled, "VOID-FILL BAG FILLING SYSTEM AND METHOD," having Ser. No. 60/356,270, filed Feb. 11, 2002, which is entirely incorporated herein by reference.

BACKGROUND OF THE INVENTION

Shipping items in packages require that the shipped items be firmly secured within the shipping package so that the shipped items are protected. Paper, air bags, styrofoam, "peanuts," "bubble wrap" or other suitable packing materials are used to surround the shipped item to provide protection from jarring motions, penetration by foreign objects, and to prevent movement of the item within the shipping package container during shipping. However, installing such packing material around the shipped item requires substantial time, cost, and effort. Furthermore, once used, the packing material often becomes environmentally unfriendly waste.

Another packaging system inserts one or more deflated void-fill bags in the shipping package. When the void-fill bags are filled with a gas or liquid, such as air, the void-fill bag is expanded to firmly secure the shipped item within the shipping package. However, void-fill bag-inflating machinery is very complex. One example of such a void-fill bag-inflating machine is disclosed in U.S. Pat. No. 6,253,806 B1 to Sperry et al., entitled "INFLATABLE PACKING MATERIAL AND INFLATION SYSTEM," which is incorporated herein in its entirety.

SUMMARY OF THE INVENTION

The present invention provides a system and method for securing package contents. Briefly described, in architecture, one embodiment comprises a supply conveyor configured to transport at least one package having at least one deflated void-fill bag, the void-fill bag having a collar protruding through the package, an inflate nozzle configured to sealably couple with the collar such that the void-fill bag may be filled to secure contents of the package, a vision system configured to detect a target associated with the collar of the void-fill bag, and a servo-drive system configured to control a position of the inflate nozzle based upon the detected target such that the position of the inflate nozzle is adjusted to sealably couple the inflate nozzle with the collar.

Another embodiment is a process comprising visually detecting the position of a target, the target corresponding to a collar of a void-fill bag residing in a package, determining the location of the collar based upon the detected position of the target, aligning an inflate nozzle with the collar, sealably coupling the inflate nozzle to the collar, and filling the void-fill bag with a gas communicated from the inflate nozzle through the collar.

BRIEF DESCRIPTION OF THE DRAWINGS

Other features of the present invention will be more readily understood from the following detailed description of a specific embodiment thereof when read in conjunction with the accompanying drawings, in which.

DETAILED DESCRIPTION OF THE PREFERRED EMBODIMENT

Figure 1:
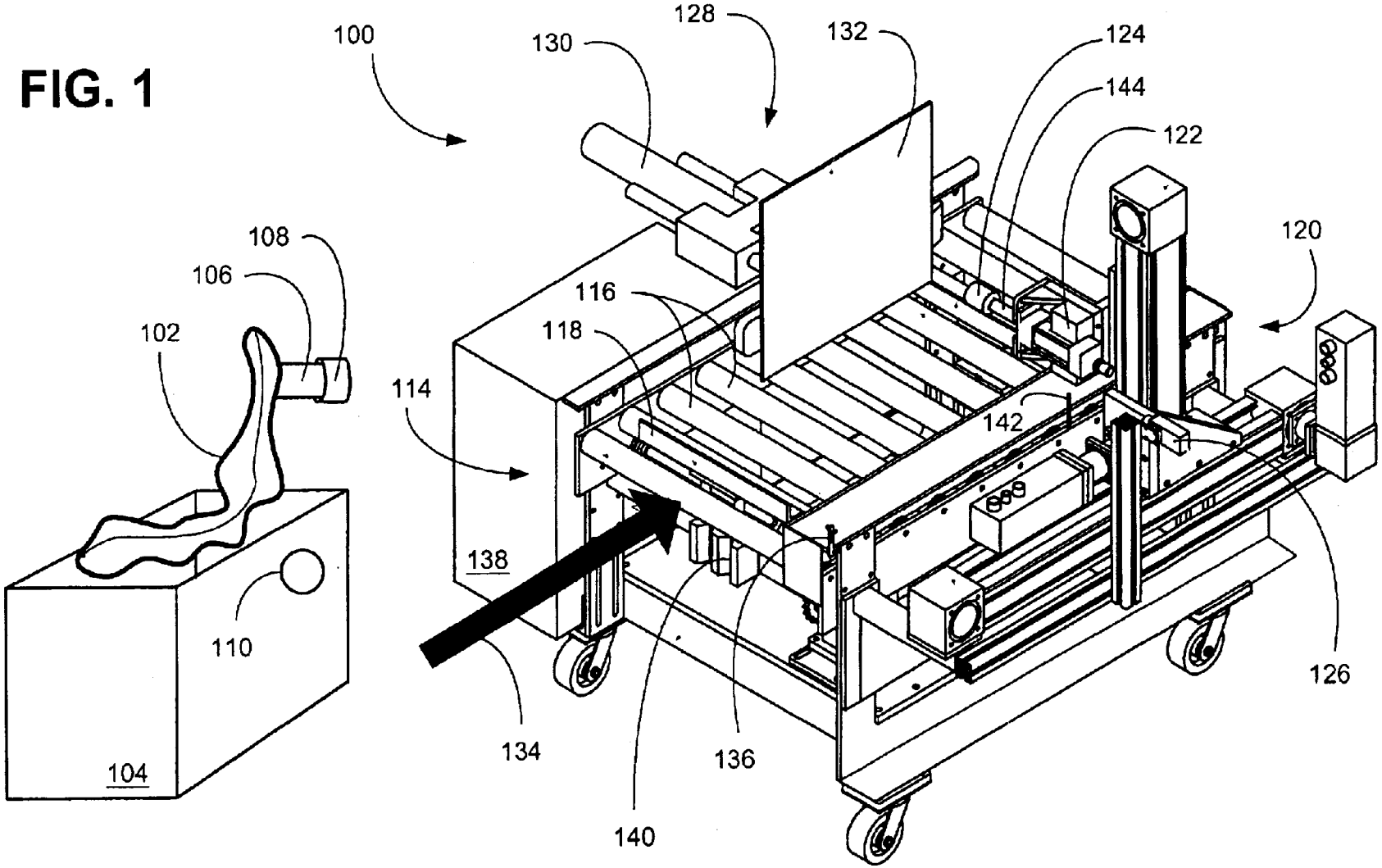
FIG. 1 is a perspective view of an automatic bag inflating machine according to the present invention.

One embodiment of the invention is a method of inflating a void-fill bag in a package container. Examples of package containers include, but are not limited to, cardboard boxes, paper envelopes, plastic enclosures and crates.

In one embodiment of the present invention, an operator upstream from the void-fill bag-inflating machine 100 places the appropriate sized, deflated, void-fill bag 102 in the package container 104. The void-fill bag 102 is positioned such that when the void-fill bag 102 is inflated, as described below, the void-fill bag 102 secures the shipped item (not shown) within the package container 104. Void-fill bags 102 may be inserted into a package container by any suitable means.

The void-fill bag 102 includes at least a fill channel 106 and a collar 108. The collar 108 is configured to be inserted through hole 110 or other suitable aperture in the package container 104. Accordingly, after insertion of the void-fill bag 102 into the package container 104, the collar 108 is accessible from the outside of the package container 104.

FIG. 1 is a perspective view of an embodiment of the automatic void-fill bag-inflating machine 100 according to the present invention. One exemplary embodiment of the automatic void-fill bag-inflating machine 100 is comprised of at least a product supply conveyor 114 having a plurality of rollers 116, an infeed stop actuator 118, a servo-drive system 120, an inflate nozzle actuator 122, an inflate nozzle 124, a vision sensor 126 and a side-push mechanism 128 having a side-push actuator 130 and side-push member 132. Inflate nozzle 124 is configured to sealably couple with collar 108.

The operator seals the package container 104 manually, or by conveying through an automatic case sealer (not shown), and places package container 104 on an infeed conveyor (not shown) which feeds the sealed package container 104 to the product supply conveyor 114. The package container 104 enters an embodiment of the product supply conveyor 114 and rests upon the plurality of rollers 116 configured to support the package container 104 and to convey the package container 104 into the appropriate position in the void-fill bag-inflating machine 100, as illustrated by arrow 134. Alternatively, the package container 104 may be placed directly onto the product supply conveyor 114.

The package container 104 advances over the plurality of rollers 116 until the package container 104 contacts infeed stop actuator 118. In one embodiment, infeed sensor 136 detects the presence of the package container 104. The infeed sensor 136 is in communication with a control system 138. Upon receiving a suitable signal from the infeed sensor 136, control system 138 causes a mechanical actuator system 140 to move the infeed stop actuator 118 from a retracted position into a fixed position protruding above the rollers 116 such that the package container 104 engages the infeed stop actuator 118.

Any suitable sensor device configured to detect the presence of the package container 104 may be employed as infeed sensor 136. For example, but not limited to, a video detection system, an infrared or laser detection system, a weight sensitive sensor or pressure sensitive sensor may be employed in alternative embodiments of an automatic void-fill bag-inflating machine 100. Furthermore, any suitable local or remote control system 138 and mechanical actuator system 140 may be configured to cause the positioning of the infeed stop actuator 118 as described above.

Figure 2A:
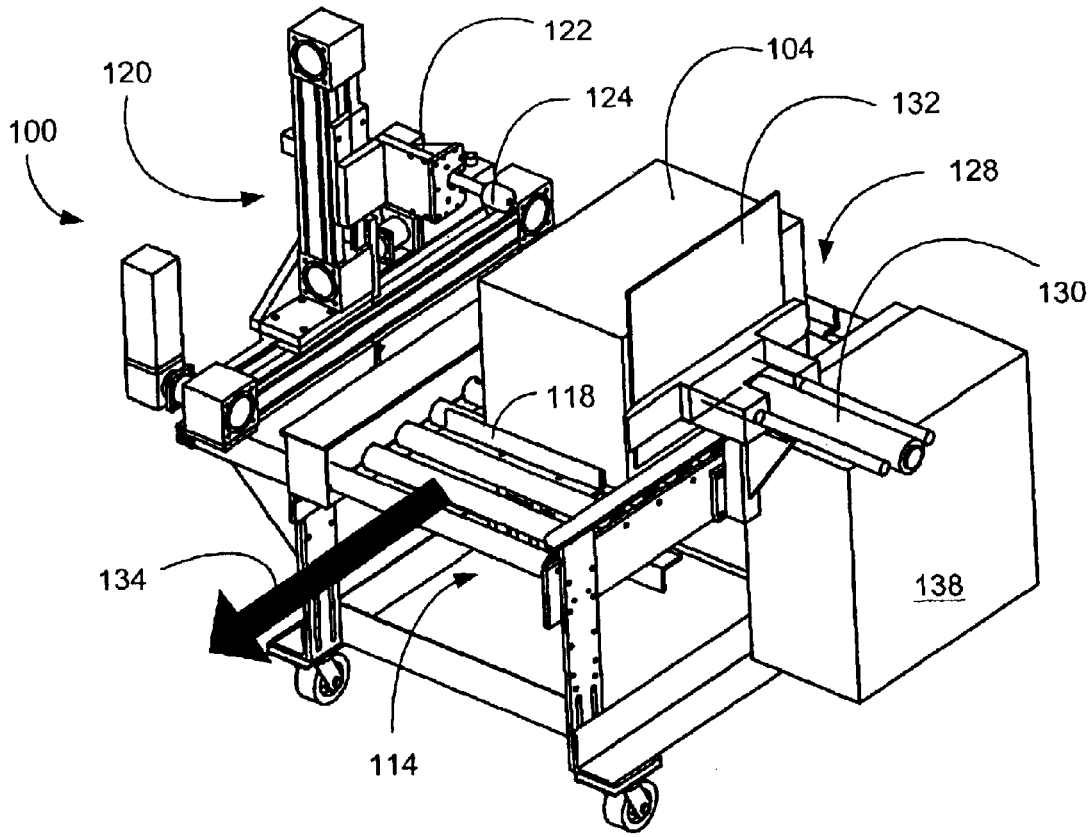
FIGS. 2A and 2B are perspective views of the automatic bag inflating machine shown with a package container.
Figure 2B:
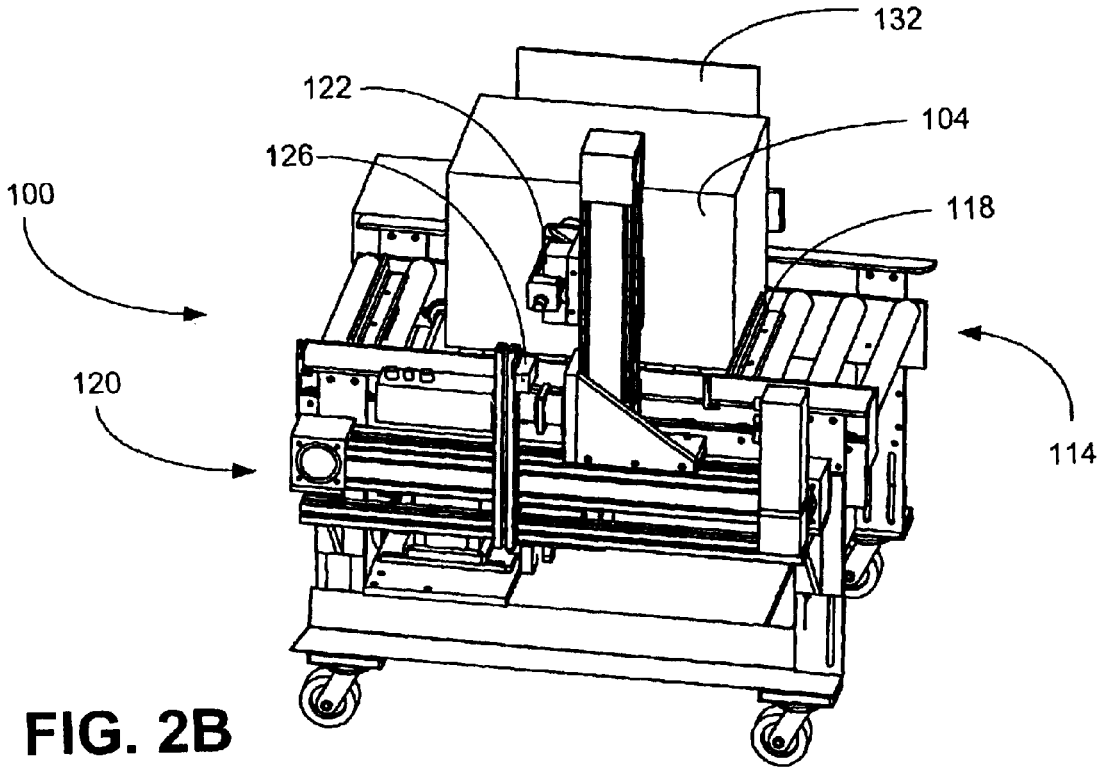

FIGS. 2A and 2B are perspective views of the automatic void-fill bag-inflating machine 100 shown with a package container 104. Accordingly, it is understood that the product supply conveyor 114 has advanced the package container 104, as indicated by the direction arrow 134, into a predefined position between the side-push mechanism 128 and the servo-drive system 120. The position of the package container 104 is detected by sensor 142 (FIG. 1). Sensor 142 may be implemented using any of the above-described sensors. When the package container 104 is advanced to the predefined position by the product supply conveyor 114, the product supply conveyor 114 stops.

The inflate nozzle actuator 122 is initially in a retracted position. Accordingly, the inflate nozzle is positioned so as not to hinder the proper positioning of the package container 104. Furthermore, the servo-drive system 120, described in greater detail below, is configured such that the position of the inflate nozzle 124 relative to the vision sensor 126 is known.

Figure 3:
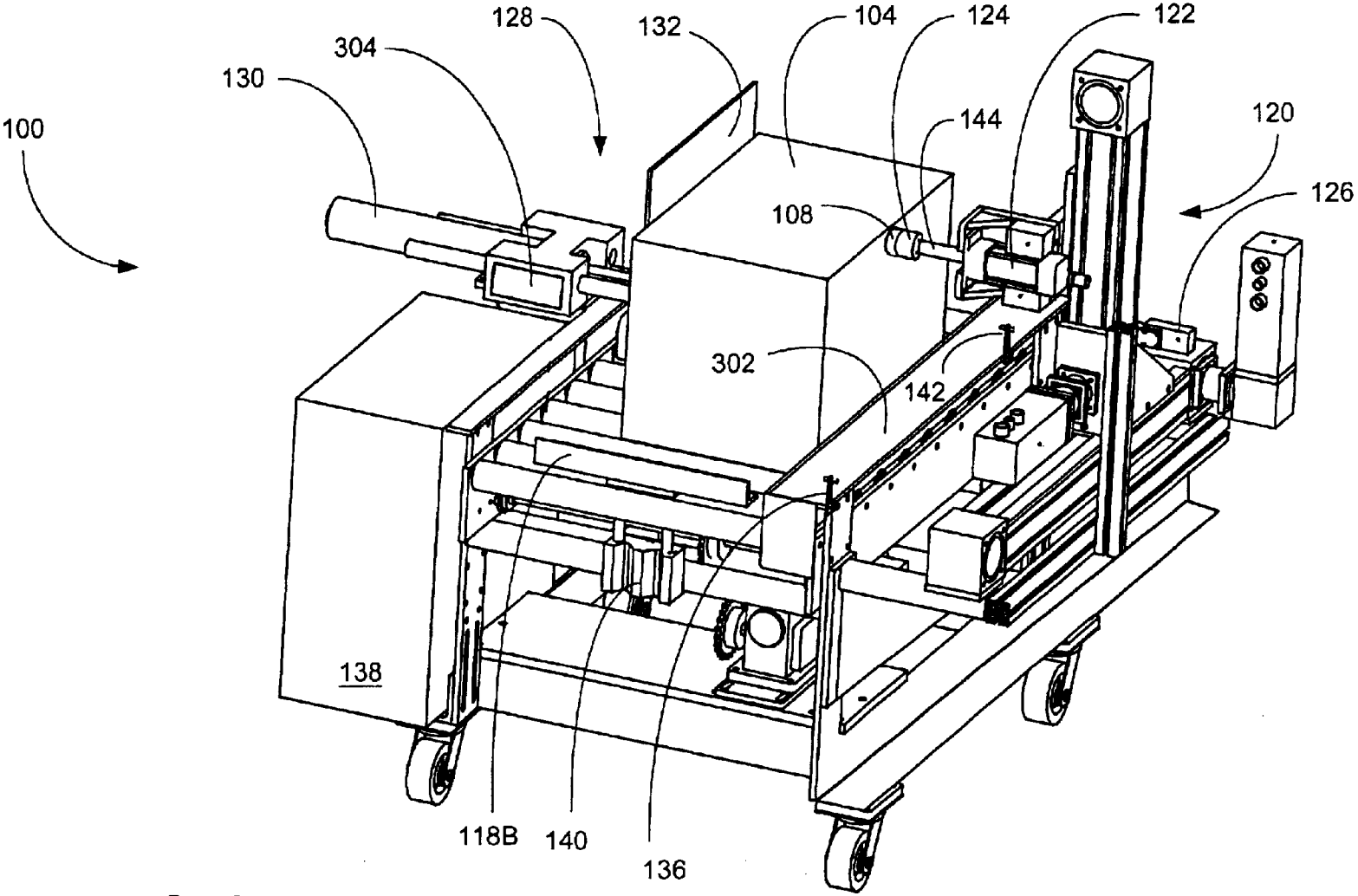
FIG. 3 is a perspective view of the automatic bag inflating machine shown with a package container clamped in the inflate position.

FIG. 3 is a perspective view of the automatic void-fill bag-inflating machine 100 shown with the package container 104 clamped in the inflate position. When the package container 104 is positioned as illustrated in FIGS. 2A and 2B, control system 104 causes the side-push actuator 130 to extend such that the side-push member 132 engages the package container 104 such that the package container 104 is clamped into position. The side-push actuator 130 advances the side-push member 132 to cause the package container to be moved into contact with a restraining member 302 that is affixed to the void-fill bag-inflating machine 100.

One embodiment employs an optional sensor 304 to detect that the package container 104 is snugly held in position between the side-push member 132 and the restraining member 302. Accordingly, the package container 104 is held in a fixed position, but not so tightly as to damage the package container 104. Sensor 304 is preferably a pressure sensitive device configured to communicate a control signal to the control system 138. Other embodiments employ other types of suitable devices for sensor 304. Another embodiment does not employ sensor 304 since the force exerted by the side-push member 132 is controllable. In embodiments employing sensor 304, upon receiving a signal from the sensor 304, control system 138 causes the side-push actuator 130 to stop and remain in a fixed position to hold the package container 104 in the fixed inflate position as shown.

For convenience of illustration, a second infeed stop actuator 118B is illustrated. Accordingly, it is understood that the automatic void-fill bag-inflating machine 100 is ready to receive the next package container. Furthermore, because the automatic void-fill bag-inflating machine 100 is configured to operate on a variety of different types, shapes and sizes of package containers, the next package container need not be the same as the package container 104.

Figure 4:
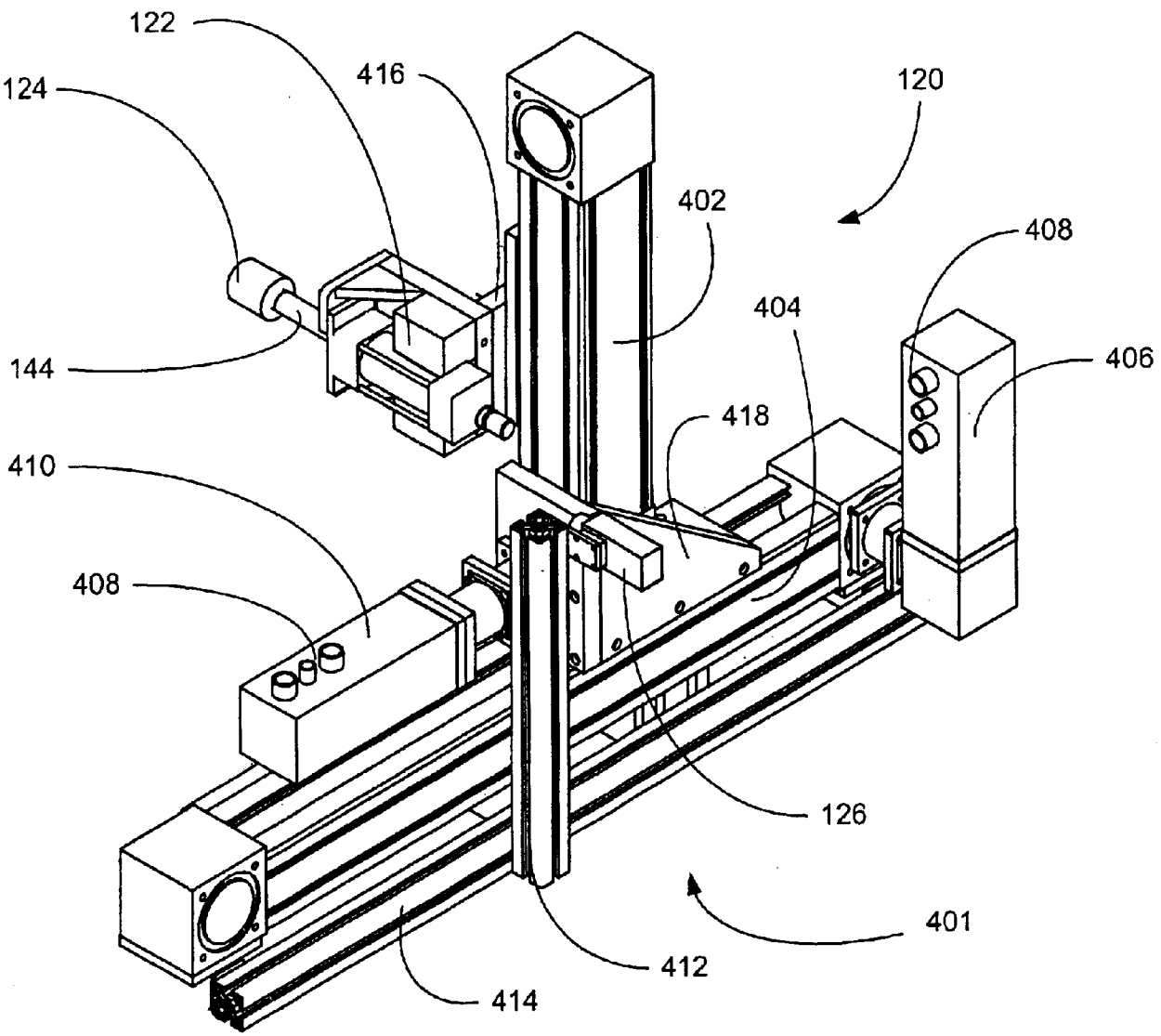
FIG. 4 is a perspective view of the servo-drive system and a vision sensor position system employed by one embodiment of the automatic bag inflating machine.

FIG. 4 is a perspective view of the servo-drive system 120 and a vision sensor position system 401 employed by one embodiment of the automatic void-fill bag-inflating machine 100 (FIG. 1). The servo-drive system 120 includes at least a vertical nozzle-support member 402, a horizontal nozzle-support member 404, a vertical nozzle-support member coupler unit 406 having at least one connector 408 and a horizontal nozzle-support member coupler unit 410 having at least one connector 408. The vision sensor position system 401 includes at least a vertical vision sensor position member 412 and a horizontal vision sensor position member 414.

Initially, the servo-drive system 120 is in a home or start position. As described above, the home position locates the inflate nozzle 124 such that the inflate nozzle 124 does not hinder movement of the package container 104 (FIG. 1) when the package container 104 is positioned as described above.

The inflate nozzle actuator 122 is coupled to a connector 416. Connector 416 is further coupled to the vertical nozzle-support member 402. The vertical position of the connector 416 is controlled by a suitable servo motor drive system (not shown) residing in the vertical nozzle-support member 402. Accordingly, the inflate nozzle actuator 122 is positioned such that the inflate nozzle can couple to the collar 108 (FIG. 1) of the void-fill bag, as described below in greater detail. The servo motor drive system is controlled by the control system 138 (FIG. 1). The vertical nozzle-support member 402 is coupled to the vertical nozzle-support member coupler unit 410. The coupler unit 410 has connectors 408 such that a control connection and a power source is provided to the servo motor drive system (not shown) residing in the vertical nozzle-support member 402.

The vertical nozzle-support member 402 is coupled to a connector 418. Connector 418 is coupled to the horizontal nozzle-support member 404. The horizontal position of the connector 418 is controlled by another servo motor drive system (not shown) residing in the horizontal nozzle-support member 404. Accordingly, the vertical nozzle-support member 402 is positioned such that the inflate nozzle can couple to the collar 108 of the void-fill bag, as described below in greater detail. The servo motor drive system is controlled by the control system 138. The horizontal nozzle-support member 404 is coupled to a vertical nozzle-support member coupler unit 406. The coupler unit 406 has connectors 408 such that a control connection and a power source is provided to the servo motor drive system (not shown) residing in the horizontal nozzle-support member 404.

The above-described servo-drive system is an illustrative example of one embodiment of an automatic void-fill bag-inflating machine 100. Any suitably controlled device configured to position an inflate nozzle 124 so that the inflate nozzle 124 is coupled to the collar 108, and such that the void-fill bag 102 (FIG. 1) is filled in accordance with the present invention, is intended to be disclosed herein. For example, an inflate nozzle 124 could be coupled to an extendable, rotatable arm such that the inflate nozzle 124 is moved to and coupled with collar 108.

One embodiment of the automatic void-fill bag-inflating machine 100 includes a vision sensor position system 401. Vision sensor 126 is positioned so as to have an unobstructed view of the incoming package container 104. One embodiment of the vision sensor position system 401 includes at least a vertical vision sensor position member 412 and a horizontal vision sensor position member 414. The vision sensor 126 is coupled to one end of the position member 412 using a slidable connector and a securing means such that the vision sensor can be positioned in a desirable vertical position. The position member 414 is coupled to the other end of the position member 412 using a slidable connector and a securing means such that the vision sensor 126 can be positioned in a desirable horizontal position.

Vision sensor position system 401 allows the vision sensor 126 to be positioned such that a target on the package container 104 can be viewed. For example, but not limited to, the target can be the collar 108. Accordingly, when the servo-drive system 120 is in the home position, the vision sensor 126 has an unobstructed view of the incoming package container 104 and collar 108.

When the package container 104 has been firmly clamped in the above described inflate position, a vision system determines the position of a target, such as the collar 108. The vision sensor 126 detects the target and communicates a signal to the control system 138. Control system 138 determines the location of the exposed collar 108. In one embodiment, vision sensor 126 takes a "snap" shot of the package container 104 and the control system 138 calculates the position of the collar 108 on the side of the package container 104. Any suitable coordinate system, such as a Cartesian coordinate system defining distances along an X axis and a Y axis, or a polar coordinate system defining an angle and a distance, may be employed to define the position of the collar 108. The position of the collar 108 may be defined with respect to any predetermined point on the automatic void-fill bag-inflating machine 100. For example, but not limited to, the location of collar 108 in one embodiment is defined relative to the inflate nozzle 124.

Once the position of the collar 108 is determined, the servo-drive system 120 operates such that the inflate nozzle 124 is aligned with the collar 108. As illustrated in FIG. 3, the inflate nozzle actuator 122 extends a nozzle shaft 144 such that the inflate nozzle 124 is in contact with the collar 108. The inflate nozzle actuator 122 extends the nozzle shaft 144 such that sufficient frictional pressure is maintained between the inflate nozzle 124 and the collar 108 so that when gas, or a suitable liquid, is injected into the void-fill bag 102, no gas (or liquid) seeps out between the inflate nozzle 124 and the collar 108. A sensor and control system, described below, is employed in one embodiment to maintain the desired contact pressure between the inflate nozzle 124 and the collar 108. Accordingly, the inflate nozzle 124 and the collar 108 remain sealably coupled without causing damage to the package container 104.

In another embodiment, at least a portion of the nozzle shaft 144 is a flexible hose or the like configured to communicate gas or liquid to the inflate nozzle 124. Position of the inflate nozzle 124 would be controlled by another member (not shown) positioned by a suitable servo-drive system.

In one embodiment, the determined position of the collar 108 is used to determine the pressure that the void-fill bag 102 is to be filled to. That is, the determined position of collar 108 provides information regarding the package container 104 height and/or length. The position of the side-push member 132, in another embodiment, provides information regarding the depth of the package container 104. The determined dimensions of the package container 104, based upon at least the determined location of the collar 108, is used to determine the predetermined fill pressure of the void-filling bag 102, described below in greater detail.

Figure 5:
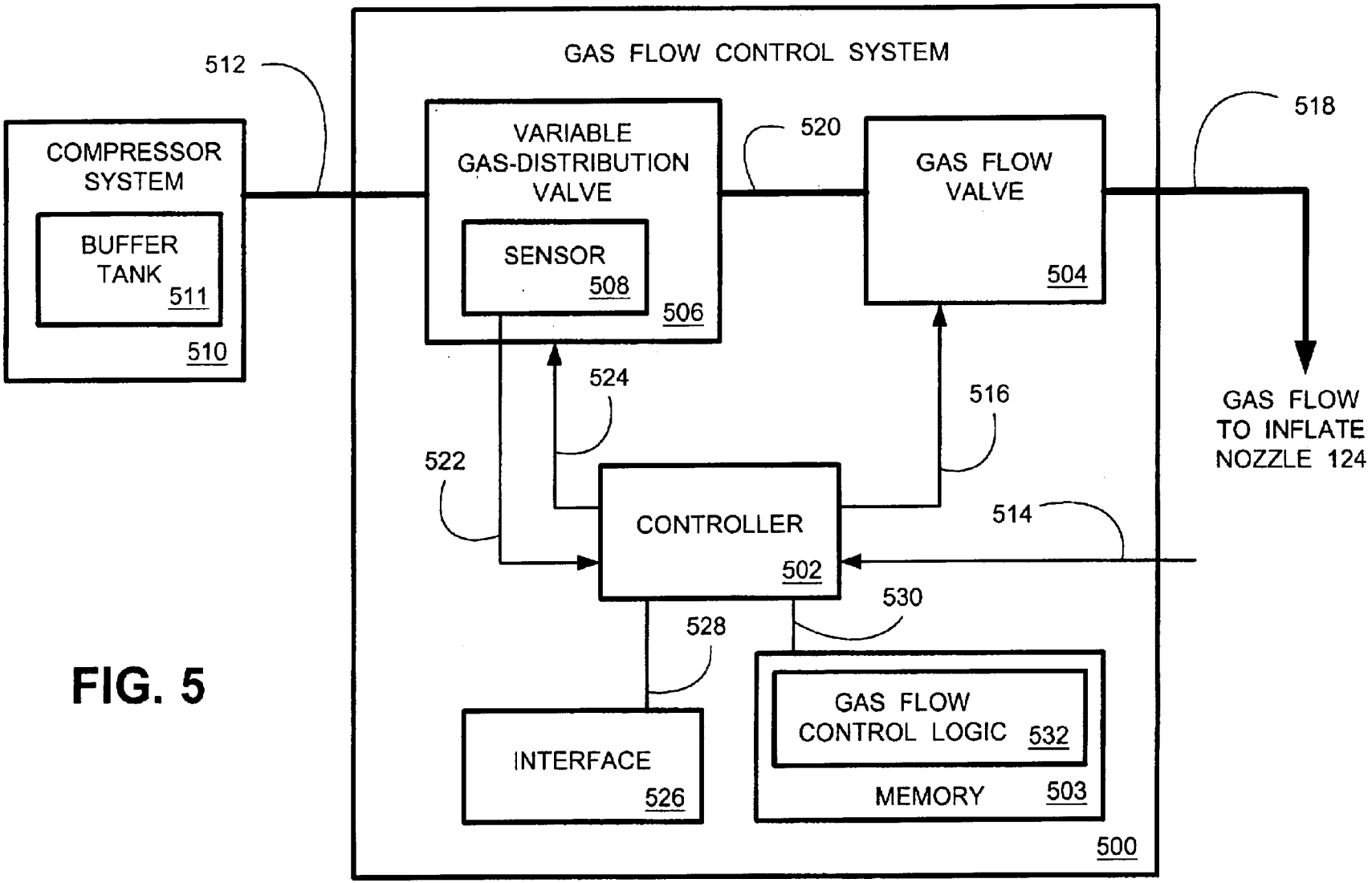
FIG. 5 is a block diagram of one embodiment of a gas flow control system.

FIG. 5 is a block diagram of one embodiment of a gas flow control system 500 employed in an embodiment of the void-fill bag-inflating machine 100 (FIG. 1). The gas flow control system 500 resides in a suitable location in the automatic void-fill bag-inflating machine 100 or as a stand-alone unit remotely located from the automatic void-fill bag-inflating machine 100. Gas pressure is adjustable by the gas flow control system 500, which operates as a closed loop pressure regulator.

The gas flow control system 500 includes at least a controller 502, a memory 503, a gas flow valve 504 and a variable gas-distribution valve 506. The variable gas-distribution valve 506 includes at least a sensor 508 configured to detect gas pressure corresponding to pressure in the void-fill bag 102 (FIG. 1). Gas flow valve 504 and variable gas-distribution valve 506 are implemented as solenoid valves in one embodiment. Other embodiments employ air, any suitable gas or liquid control mechanisms that operate in accordance with the present invention as described herein.

The gas flow control system 500 is coupled to a compressor system 510 via connection 512. Compressor system 510 is configured to provide a pressurized source of gas, or a suitable liquid, having a source pressure at least equal to the predetermined fill pressure in a filled void-fill bag 102. Preferably, the pressure delivered by compressor system 510 exceeds the predetermined fill pressure. Any suitable compressor system may be used. Also, compressor system 510 preferably includes a buffer tank 511 configured to maintain a volume of gas, or a suitable liquid, at substantially a predefined constant pressure. Thus, pressure changes and/or volumetric changes caused by operation of a compressor, and/or pressure changes and/or volumetric changes caused by other loads on the compressor system 510, will not adversely impact the pressure and/or flow rate provided to the gas flow control system 500.

Once the inflate nozzle 124 is extended to be in contact (sealably coupled) with the collar 108, a control signal is generated indicating that the void-fill bag 102 is ready to be filled. This control signal is communicated to controller 502, via connection 514.

Controller 502, via connection 516, actuates gas flow valve 504 to allow gas (such as air or other suitable safe gas) or a suitable liquid, provided by compressor system 510 to flow into the void-fill bag 102, via connection 518. Accordingly, it is understood that connection 518 is any suitable gas (or liquid) transportation system configured to transport gas (or liquid) to the inflate nozzle 124. Furthermore, it is understood that the variable gas-distribution valve 506 is initially open or concurrently opened with the gas flow valve 504.

Accordingly, void-fill bag 102 begins to fill with gas (or liquid). Sensor 508 is configured to detect pressure on connection 520. Pressure on connection 520 correlates to gas pressure within the void-fill bag 102. The detected pressure is communicated to controller 502, via connection 522.

As the sensed pressure approaches a predetermined void-bag fill pressure, controller 502 communicates a control signal, via connection 524, to the variable gas-distribution valve 506 which causes the variable gas-distribution valve 506 to actuate so that gas flow is reduced. Accordingly, gas flow is reduced so that the void-fill bag 102 is filled more slowly. When the sensor 508 detects that the predetermined pressure has been reached, controller 502 causes the gas flow valve 504 to shut off, thereby stopping the flow of gas into the void-fill bag 102. In another embodiment, controller 502 causes the variable gas-distribution valve 506 to shut off. Thus, the void-fill bag 102 is filled to a predefined fill pressure, as described herein in accordance with the present invention, such that the packaged item is firmly secured within package container 104 (FIG. 1).

Alternatively, sensor 508 may be implemented as an in-line sensor located on connection 520 or on connection 518. For example, one embodiment locates sensor 508 within the inflate nozzle actuator 122 (FIG. 1), or very close to the inflate nozzle actuator 122 such that the pressure within the void-fill bag 102 is more accurately sensed.

In yet another embodiment, a suitable variable gas flow valve is employed that provides the same functionality of both the gas flow valve 504 and the variable gas-distribution valve 506. Sensor 508 may be included as an integral part of the variable gas flow valve or implemented as an in-line sensor located on connection 520 or on connection 518.

One embodiment of the gas flow control system includes an interface 526, coupled to controller 502 via connection 528. Interface 526 is a suitable interface device configured to receive commands from an operator. For example, a valve corresponding to the predetermined pressure to which a void-fill bag 102 is filled may be specified, depending upon the nature of the shipped item and the package container 104. Another embodiment is configured to receive information defining the predetermined pressure from another controller (not shown). Such a controller is configured to fill a variety of different types of void-fill bags 102 residing in a variety of package containers. For example, but not limited to, if the automatic void-fill bag-inflating machine 100 is incorporated into an assembly line that communicates a variety of products for shipping in a variety of package containers 104, the assembly line controller would have information regarding each product, each package container 104, and the associated void-fill bags 102, progressing down the assembly line. Such information would be analyzed to define a suitable fill pressure for each void-fill bag 102 and communicated to the controller 502 at the appropriate time.

Another embodiment is configured to communicate information from the controller 502 back to the interface 526. For example, the final fill pressure of the void-fill bag 102 may be communicated to the interface 526 for quality control purposes. Such information could be used for reporting or used to reject an improperly filled void-fill bag 102.

Furthermore, depending upon the nature of the shipped item, the package container 104 and the void-fill bag 102 (FIG. 1), the fill rate of the void-fill bag 102 may be changed. For example, it may be desirable in some applications to fill a void-fill bag 102 more slowly such that additional time is provided of the shipped item to settle within the package container 104. Accordingly, controller 502 would actuate variable gas-distribution valve 506 in a manner such that gas is injected into the void-fill bag at a slower rate. Furthermore, controller 502 could be configured to actuate variable gas-distribution valve 506 such that gas flow is controlled at a predefined variable rate.

Memory 503 is coupled to controller 502, via connection 530. Controller 502 retrieves and executes a program, the gas flow control logic 532, to perform the processes and functions described herein. An embodiment of the gas flow control logic 532 is described in greater detail below.

Once a void-fill bag 102 is filled, the inflate nozzle 124 is retracted. Collar 108 (FIG. 1) is configured such that the gas in the void-fill bag 102 (or other suitable gas or liquid) cannot escape back out of the collar 108 when the inflate nozzle 124 is retracted from the collar 108. In one embodiment, the inflate nozzle 124 is returned to the home position by the servo-drive system 120 to await instructions for filling the next void-fill bag 102. In another embodiment wherein multiple void-fill bags 102 on the same shipping container 104 are to be filled, the servo-drive system 120 moves the inflate nozzle 124 to the next collar 108.

In one embodiment, once the void-fill bag 102 is filled (or all void-fill bags 102 in the package container 104 are filled), the product supply conveyor 114 moves the package container 104 such that the package container 104 is progressed to another conveyor system (not shown). Another embodiment is configured to release the package container 104 so that an operator can manually remove the package container 104 from the automatic void-fill bag-inflating machine 100.

Figure 6:
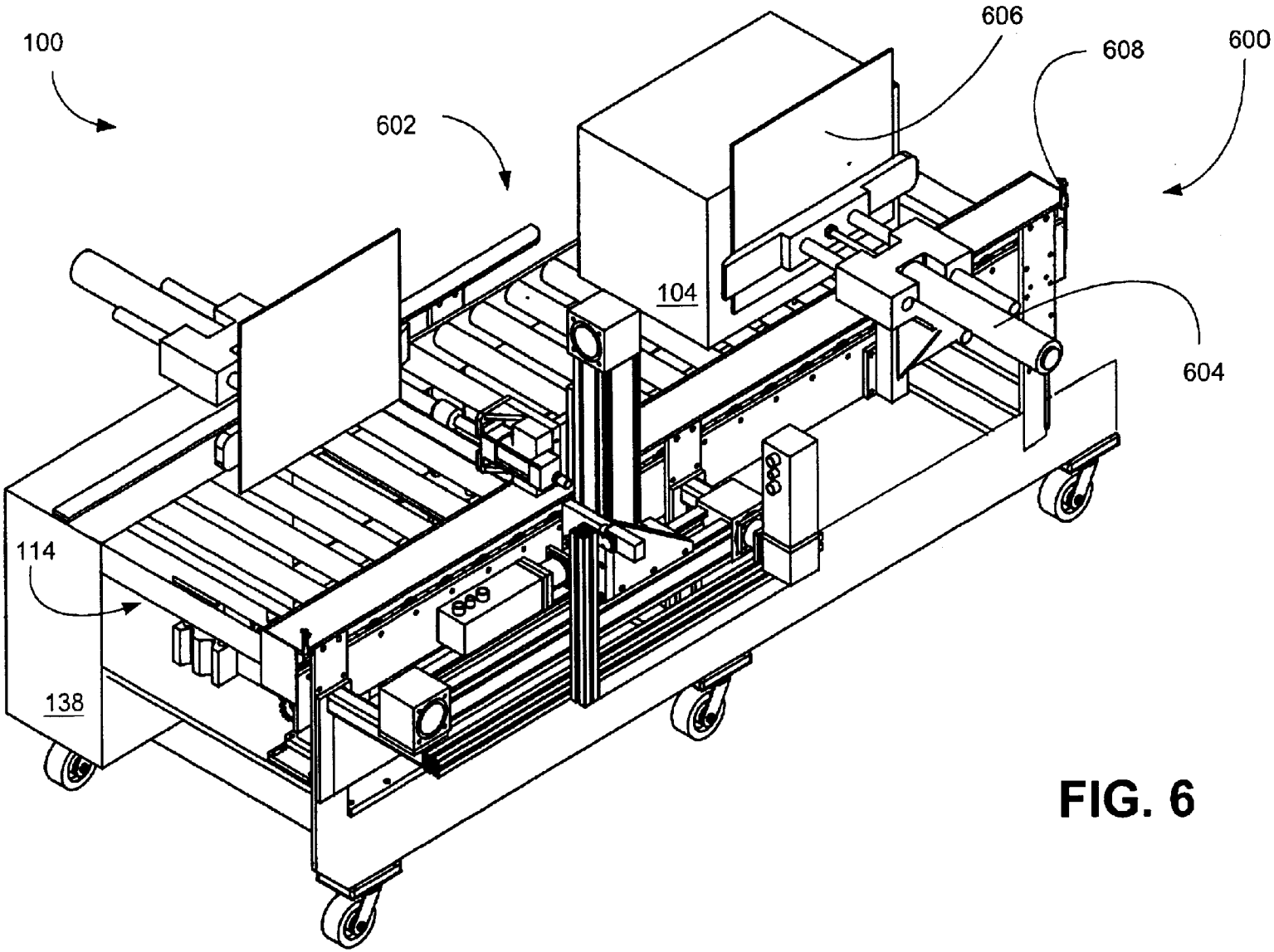
FIG. 6 is a perspective view of another embodiment of an automatic bag inflating machine with a package container rejecting unit.

FIG. 6 is a perspective view of another embodiment of an automatic void-fill bag-inflating machine 100 with a package container rejecting unit 600. Package container rejecting unit 600 includes at least a product supply conveyor extension 602, a rejection actuator 604, a rejection member 606 and a sensor 608.

The package rejection unit 600 in one embodiment is an integral part of the package automatic void-fill bag-inflating machine 100 such that the product supply conveyor 114 and the product supply conveyor extension 602 are a single unit. In another embodiment, the package rejection unit 600 is a stand-alone unit that is configured so that the product supply conveyor 114 and the product supply conveyor extension 602 align with each other.

In an embodiment configured to determine if a void-fill bag 102 (FIG. 1) has been properly filled, the package rejection unit 600 is configured to isolate and move a package container 104 having an improperly filled void-fill bag 102 to a location where the problem can be fixed. For example, but not limited to, the void-fill bag 102 may be under-filled, over-filled, improperly positioned after filling, or the collar may be leaking. One embodiment employs a pressure sensor to detect the final pressure in the void-fill bag 102. If the final pressure is substantially greater than or less than a desired pressure, the void-fill bag 102 is known to be improperly filled. Thus, it is desirable to isolate and move the package container 104 having an improperly filled void-fill bag 102.

The product supply conveyor extension 602 advances the package container 104 into a position suitable for rejection, described below. The position of the package container 104 is detected by sensor 608. In one embodiment, when a problem is detected, the package container 104 is advanced to a predefined position by the product supply conveyor extension 602 and the product supply conveyor extension 602 stops.

When a problem is detected, control system 138 communicates a control signal to the package rejection unit 600 such that the reject actuator 604 causes the rejection member to advance. Accordingly, the package container 104 is moved. Thus, the package container 104 having a problem can be isolated and moved out of the way such that other package containers following the rejected package container 104 may progress through the product supply conveyor extension 602 for further processing.

The described embodiment of the void-fill bag-inflating machine 100 was described above as configured to fill a single void-fill bag 102. An alternative embodiment of the void-fill bag-inflating machine 100 can be instructed to fill any predetermined number of void-fill bags 102. Furthermore, another embodiment of a void-fill bag-inflating machine 100 is configured with multiple servo-drive systems 120 and vision systems 126, as described above, such that a plurality of inflate nozzles 124 are available to fill a plurality of void-fill bags. For example, such an additional system could be installed on the opposing side of the void-fill bag-inflating machine 100 so that collars protruding from the opposing side of the package container 104 are filled. Another embodiment operates in conjunction with a machine configured to reposition the package container 104. For example, one such machine may employ a platter or other moveable surface such that the package container 104 is rotated so that collars 108 exposed on the other sides of package container 104 are coupled to the inflate nozzle 124.

Another embodiment of the void-fill bag-inflating machine is configured such that the inflate nozzle 124 is aligned with a collar 108 using a three, four, five or six axis robot mechanism controlled by a vision system. That is, the robot system has a multiple-axis servo-drive system to control position of the inflate nozzle. Accordingly, when the package container 104 is securely fixed in position, the robot couples the inflate nozzle 124 and a collar 108 such that the void fill bag 102 is filled in accordance with the present invention. Furthermore, the robot may be configured to detect a plurality of collars 108 such that a plurality of void-fill bags 102 are filled.

Figure 7:
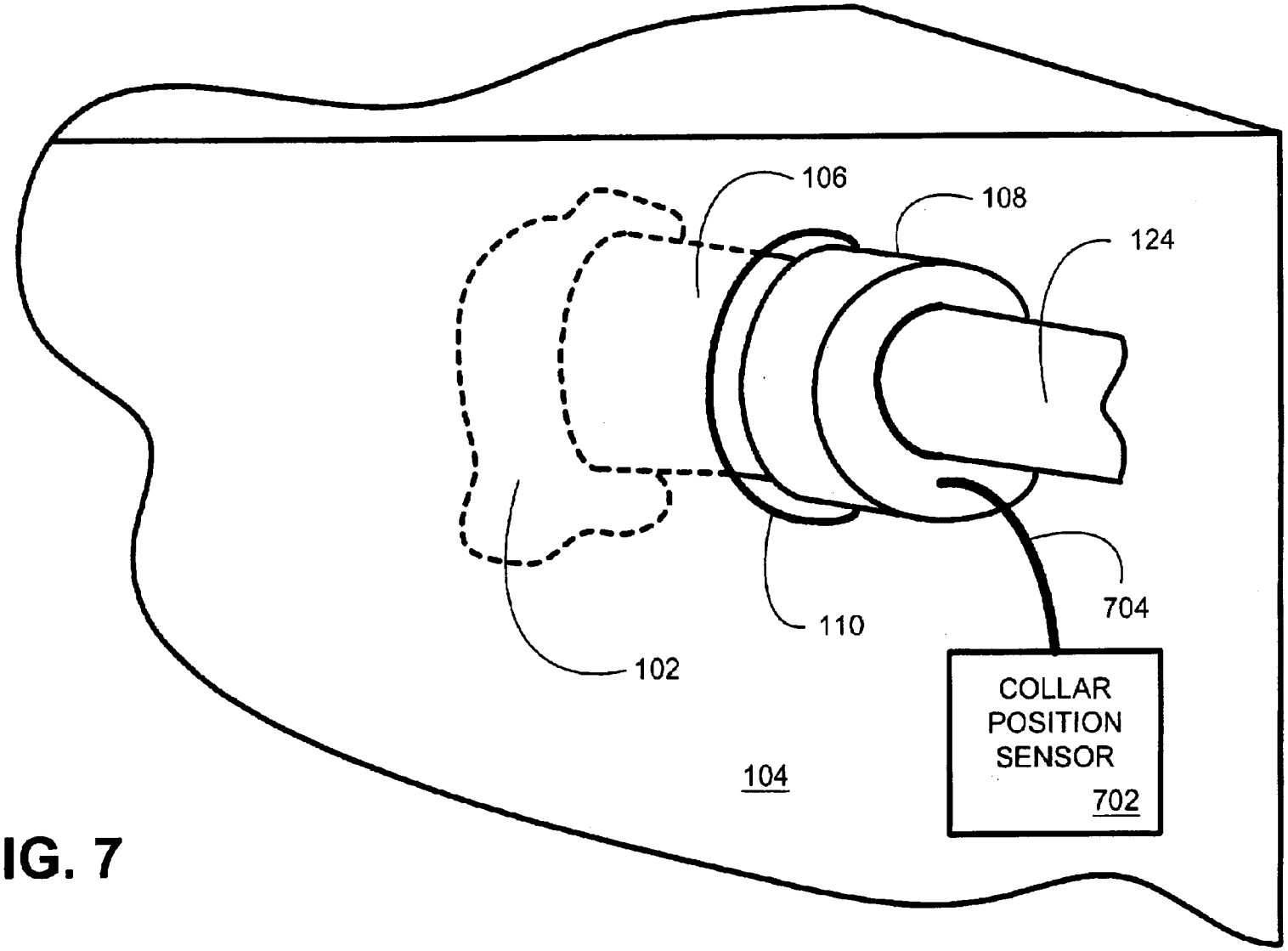
FIG. 7 is a perspective view of another embodiment of an automatic bag inflating machine with a collar position sensor.

The above-described embodiments of the automatic void-fill bag-inflating machine 100 were disclosed as employing a pressure sensing system to detect when the void-fill bag 102 was filled to the predefined fill pressure. FIG. 7 is a perspective view of another embodiment of an automatic void-fill bag-inflating machine 100 (FIG. 1) with a collar position sensor 702. A portion of a package container 104 is illustrated. For convenience, portions of the elements residing within the package container 104 are illustrated with dashed lines.

Collar position sensor 702 includes a sensor element 704 configured to detect the position of the collar 108. As the void fill bag 102 fills, the fill channel 106 is pulled further into the package container 102. Thus, the collar 108 is retracted.

Sensor element 704 detects the retraction of the collar 108 into the package container 104, thereby indicating the filling of the void-fill bag 102. At a predetermined distance of retraction of the collar 108, collar position sensor 702 communicates a signal to control system 138 (FIG. 1). Accordingly, the automatic void-fill bag-inflating machine 100 understands that the void-fill bag 102 is filled and the inflate nozzle 124 retracts, as described above. Furthermore, in another embodiment, information from the collar position sensor 702 is used to reposition inflate nozzle 124 so as to maintain a more secure connection with collar 108 during the filling of the void-fill bag 102.

Other embodiments employ other types of collar position sensors. For example, but not limited to, another collar position sensor is implemented using a vision sensor. Another embodiment employs vision sensor 126 (FIG. 1) to monitor the position of collar 108. Another embodiment is configured to detect a gap between the collar 108 and the inflate nozzle 124 as the collar 108 is retracted into the package container 104.

Figure 8:
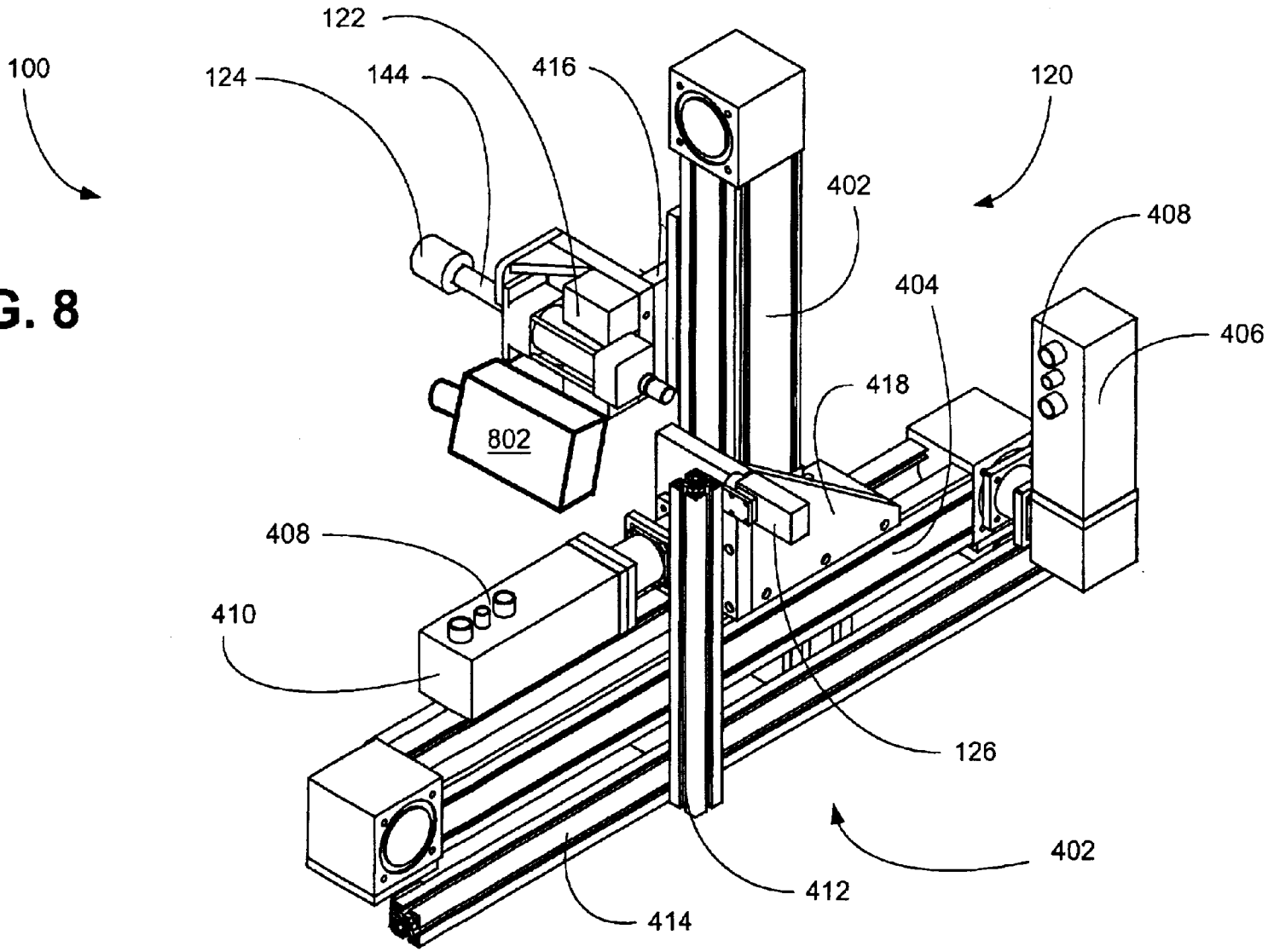
FIG. 8 is a perspective view of another embodiment of an automatic bag inflating machine with the vision sensor mounted on the inflate nozzle actuator.

FIG. 8 is a perspective view of another embodiment of an automatic void-fill bag-inflating machine 100 with the vision sensor 802 mounted on the inflate nozzle actuator 122. Accordingly, the vision sensor 802 moves as the servo-drive system guides the inflate nozzle to the collar 108 (FIG. 1). Vision sensor 802 provides real-time information to controller 138 such that the automatic void-fill bag-inflating machine 100 operates to couple the inflate nozzle 124 with collar 108 based upon information received from the vision sensor 802.

Another embodiment couples the vision sensor 802 to a suitable location on the vertical nozzle-support member 402 or on another suitable location on the servo-drive system. Yet another embodiment couples the vision sensor 126 to the inflate nozzle 124 or the nozzle shaft 144.

Another embodiment employs a product supply conveyor configured to firmly hold package container 104 (FIG. 1) as the product supply conveyor advances the package container. While the package container is moving, the vision sensor 126 detects the position of the collar 108 on a real-time basis such that the servo-drive system couples the inflate nozzle to the collar 108 as the package container 104 is moving. Accordingly, the void-fill bag 102 is filled in accordance with the present invention as the package container 104 is moving.

Figure 9:
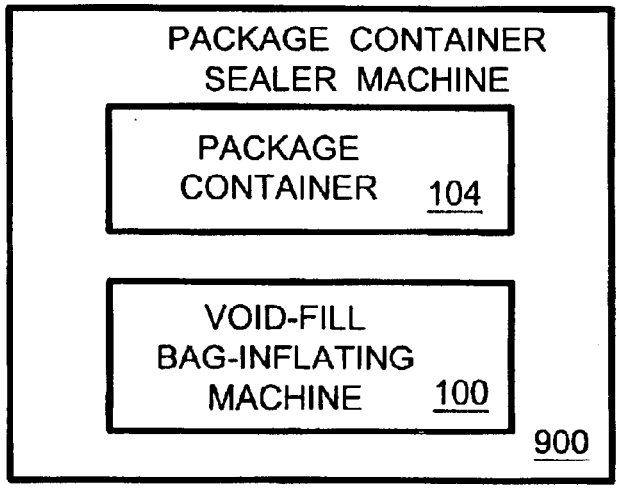
FIG. 9 is a block diagram of another embodiment of a void-fill bag-inflating machine implemented as a component of a package container sealer machine.

FIG. 9 is a block diagram of another embodiment of a void-fill bag-inflating machine 100 implemented as a component of a package container sealer machine 900. The package container sealer machine 900 is configured to receive a package container 104 having one or more void-fill bags 102. The package container sealer machine 900 seals the received package container 104 with tape, staples, glue or another suitable sealer. The void-fill bag-inflating machine 100 implemented as a component of a package container sealer machine 900 is configured to fill the void-fill bag(s) 102 in accordance with the present invention. The package container sealer machine 900 may seal the package container 104 either before, after or during the filling of the void-fill bag(s) 102.

Figure 10:
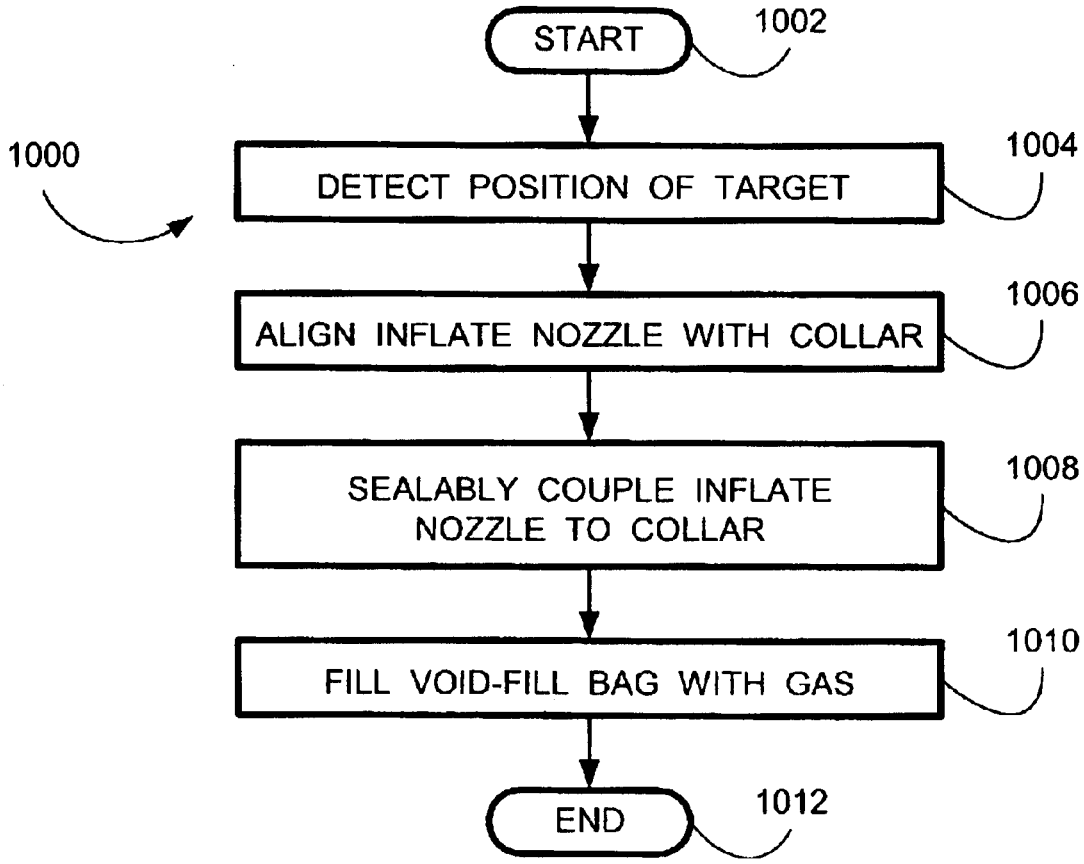
FIG. 10 is a flow chart illustrating a process, according to the present invention, for securing package contents.

FIG. 10 is a flow chart 1000 illustrating a process, according to the present invention, for securing package contents. The flow chart 1000 shows the architecture, functionality, and operation of a possible implementation of the software for implementing the gas flow control logic 532 (FIG. 5). In this regard, each block may represent a module, segment, or portion of code, which comprises one or more executable instructions for implementing the specified logical function(s). It should also be noted that in some alternative implementations, the functions noted in the blocks may occur out of the order noted in FIG. 10 or may include additional functions without departing significantly from the functionality of the void-fill bag-inflating machine 100. For example, two blocks shown in succession in FIG. 10 may in fact be executed substantially concurrently, the blocks may sometimes be executed in the reverse order, or some of the blocks may not be executed in all instances, depending upon the functionality involved, as will be further clarified hereinbelow. All such modifications and variations are intended to be included herein within the scope of this disclosure for the void-fill bag-inflating machine 100 and to be protected by the accompanying claims.

The process starts at block 1002. At block 1004 the vision sensor position system 401 (FIG. 4) detects the position of the target. As described above, the collar 108 is the target in one embodiment. At block 1006 the inflate nozzle 124 is aligned with the collar 108. As described above, one embodiment actuates the servo motor drive systems 120 that control the position of the nozzle-support member 402, via the vertical nozzle-support member 402 and the horizontal nozzle-support member 404, to align the inflate nozzle 124 with the collar 108.

At block 1008 the inflate nozzle 124 is sealably coupled to the collar 108. In one embodiment, sufficient frictional force or pressure is exerted on the inflate nozzle 124 through extension of the nozzle shaft 144 by actuation of the inflate nozzle actuator 122. At block 1010 the void-fill bag 102 is filed with gas. The process ends at block 1012.

It should be emphasized that the above-described embodiments of the present invention are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

Therefore, having thus described the invention, at least the following is claimed:

1. A system which secures package contents comprising:

a supply conveyor configured to transport at least one package having at least one deflated void-fill bag, the void-fill bag having a collar protruding through the package;

an inflate nozzle configured to sealably couple with the collar such that the void-fill bag may be filled to secure contents of the package;

a vision system configured to detect a target associated with the collar of the void-fill bag; and a servo-drive system configured to control a position of the inflate nozzle based upon the detected target such that the position of the inflate nozzle is adjusted to sealably couple the inflate nozzle with the collar.

2. The system of claim 1, further comprising a collar position sensor configured to detect position of the collar as the void-bag fills, and wherein a change in position of the collar by a predetermined distance corresponds to a filled void-fill bag.

3. The system of claim 1, wherein the supply conveyor further comprises:

a side-push member configured to engage the package;

a side-push actuator coupled to the side-push member and configured to extend the side-push member; and a restraining member such that when the side-push actuator extends the side-push member, the package is held in a fixed inflate position between the restraining member and the side-push member.

4. The system of claim 3, wherein the supply conveyor further comprises a pressure sensitive device configured to cause the side-push actuator to stop and remain in a fixed position to hold the package in the fixed inflate position.

5. The system of claim 1, wherein the servo-drive system further comprises an inflate nozzle actuator coupled to the inflate nozzle and configured to extend the inflate nozzle such that the position of the inflate nozzle is adjusted to sealably couple the inflate nozzle with the collar.

6. The system of claim 5, wherein the servo-drive system further comprises:

a connector coupled to the inflate nozzle actuator;

a vertical nozzle-support member coupled to the connector such that the connector is moveable in a vertical direction;

a first servo motor drive system coupled to the connector and configured to control a vertical position of the connector;

a horizontal nozzle-support member coupled to the vertical nozzle-support member; and a second servo motor drive system coupled to the vertical nozzle-support member and configured to control a horizontal position of the vertical nozzle-support member.

7. The system of claim 1, wherein the vision system further comprises a vision sensor.

8. The system of claim 7, wherein the vision system further comprises a vision sensor position system coupled to the vision sensor and configured to facilitate adjustment of a position of the vision sensor.

9. The system of claim 1, further comprising:

a gas flow valve configured to communicate a gas to the inflate nozzle;

a pressure regulator configured to sense a pressure of the gas; and a controller configured to receive a first signal generated by the pressure regulator corresponding to the pressure of the gas, and further configured to communicate a second signal to the gas flow valve when the pressure of the gas reaches a predefined pressure so that the gas flow valve closes.

10. The system of claim 9, wherein the controller is configured to communicate a third signal to the gas flow valve when the pressure of the gas reaches a second predefined pressure so that the gas flow valve partially closes so that the void-fill bags slowly fills to the predefined pressure.

11. The system of claim 9, further comprising an interface configured to receive commands such that a value corresponding to the predefined pressure is specified so that the predefined pressure is variable.

12. The system of claim 1, further comprising:

a pressure sensor configured to measure a final pressure of gas in the void-fill bag; and a package rejection unit configured to reject the package when the measured final pressure does not substantially equal a desired pressure.

13. The system of claim 1, further comprising a plurality of inflate nozzles configured to sealably couple with a plurality of collars such that a plurality of void-fill bags may be filled to secure contents of the package; and a plurality of servo-drive systems, each of the servo-drive systems configured to control a position of one of the inflate nozzles based upon the detected target such that the position of the inflate nozzle is adjusted to sealably couple the inflate nozzle with the collar.

14. The system of claim 1, further comprising a robot mechanism coupled to the nozzle and controlled by a multiple-axis servo-drive system configured to control position of the inflate nozzle.

15. A method for securing package contents, the method comprising:

visually detecting position of a target, the target corresponding to a collar of a void-fill bag residing in a package;

determining a location of the collar based upon the detected position of the target;

aligning an inflate nozzle with the collar;

sealably coupling the inflate nozzle to the collar; and filling the void-fill bag with a gas communicated from the inflate nozzle through the collar.

16. The method of claim 15, further comprising detecting the retraction of the collar during filling such that the retraction of the collar by a predetermined distance corresponds to a filled void-bag.

17. The method of claim 15, further comprising actuating an inflate nozzle actuator such that the inflate nozzle is extended to come into contact with the collar.

18. The method of claim 15, further comprising:

advancing the package along a conveyor;

stopping advancement of the package at a desired position; and actuating a side-push actuator such that the package is secured in a fixed position.

19. The method of claim 18, wherein actuating the side-push actuator further comprises extending a side-push member until the package is secured in the fixed position between the side-push member and a restraining member.

20. The method of claim 15, wherein aligning the inflate nozzle with the collar further comprises:

actuating a first servo motor drive system such that a vertical position of the inflate nozzle is adjusted;

actuating a second servo motor drive system such that a horizontal position of the inflate nozzle is adjusted; and actuating an inflate nozzle actuator such that the inflate nozzle is extended to come into contact with the collar.

21. The method of claim 15, wherein filling the void-fill bag with the gas further comprises:

opening a gas flow valve such that pressurized gas flows through the inflate nozzle into the void-fill bag;

detecting a pressure corresponding to a void-fill bag gas pressure; and closing the gas flow valve such that the pressurized gas flow stops.

22. The method of claim 21, further comprising:

comparing the pressure corresponding to the void-fill bag gas pressure with a predetermined pressure; and partially closing the gas flow valve when the detected pressure is at least equal to the predetermined pressure such that the pressurized gas flows slowly into the void-fill bag.

23. The method of claim 15, further comprising:

retracting the inflate nozzle; and advancing the package along a conveyor.

24. The method of claim 23, further comprising:

detecting a final void-fill bag condition; and rejecting the package when the final void-fill bag condition is undesirable.

25. The method of claim 24, wherein detecting the final void-fill bag condition further comprises sensing at least one selected from a group consisting of a final pressure, a collar position and a void-fill bag position.

26. A system for securing package contents, comprising:

means for visually detecting a position of a target, the target corresponding to a collar of a void-fill bag residing in a package;

means for determining the location of the collar based upon the detected position of the target;

means for aligning an inflate nozzle with the collar;

means for extending the inflate nozzle so that the inflate nozzle comes into contact with the collar to sealably couple the inflate nozzle to the collar; and means for filling the void-fill bag with a gas communicated from the inflate nozzle through the collar.

27. The system of claim 26, further comprising:

means for controlling a vertical position of the inflate nozzle; and means for controlling a horizontal position of the inflate nozzle.

28. The system of claim 26, further comprising:

means for opening a gas flow valve such that pressurized gas flows through the inflate nozzle into the void-fill bag;

means for detecting a pressure corresponding to a void-fill bag gas pressure; and means for closing the gas flow valve such that the pressurized gas flow stops.

29. The system of claim 28, further comprising:

means for comparing the pressure corresponding to the void-fill bag gas pressure with a predetermined pressure; and means for partially closing the gas flow valve when the detected pressure is at least equal to the predetermined pressure such that the pressurized gas flows slowly into the void-fill bag.

* * * * *